US010486214B2

(12) United States Patent
Walz et al.

(10) Patent No.: US 10,486,214 B2
(45) Date of Patent: Nov. 26, 2019

(54) TOOL FOR A PUNCHING MACHINE FOR RESHAPING PORTIONS OF A PLATE-SHAPED WORKPIECE AND METHOD THERETO

(71) Applicant: TRUMPF Werkzeugmaschinen GmbH + Co. KG, Ditzingen (DE)

(72) Inventors: Martin Walz, Stuttgart (DE); Markus Hees, Vaihingen an der Enz (DE); Yakup Coskun, Gerlingen (DE); Thomas Burzig, Ditzingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 492 days.

(21) Appl. No.: 15/267,797

(22) Filed: Sep. 16, 2016

(65) Prior Publication Data

US 2017/0080471 A1 Mar. 23, 2017

(30) Foreign Application Priority Data

Sep. 17, 2015 (DE) ..... 10 2015 217 887

(51) Int. Cl.
*B21D 22/02* (2006.01)
*B21D 5/08* (2006.01)
(Continued)

(52) U.S. Cl.
CPC ..... *B21D 22/02* (2013.01); *B21D 5/02* (2013.01); *B21D 5/0209* (2013.01); *B21D 5/042* (2013.01);
(Continued)

(58) Field of Classification Search
CPC ..... B21D 5/01; B21D 5/02; B21D 5/0209; B21D 5/0218; B21D 5/0227;
(Continued)

(56) References Cited

U.S. PATENT DOCUMENTS 5,404,742 A * 4/1995 Wilson ..... B21D 5/16 72/319
7,213,438 B2 * 5/2007 Klinkhammer ..... B21D 5/0209 72/389.4
(Continued)

FOREIGN PATENT DOCUMENTS

CN 102009094 A 4/2011
DE 20018936 U1 * 1/2001 ..... B21D 11/20
(Continued)

OTHER PUBLICATIONS

Machine Translation of DE 20018936, Translated Nov. 26, 2018, 10 Pages. (Year: 2001).*
(Continued)

*Primary Examiner* — Gregory D Swiatocha
(74) *Attorney, Agent, or Firm* — Fish & Richardson P.C.

(57) ABSTRACT

Tools for punching machines for reshaping at least one portion of a plate-shaped workpiece are described. The tools have a first tool portion that includes a first device configured to be held in a first tool holder of the punching machine and a bending stamp having a bending edge and a second tool portion including a second device configured to be held in a second tool holder of the punching machine and a bending roller configured to cooperate with the bending stamp to reshape the plate-shaped workpiece. The bending roller is rotatable around a rotation axis running parallel to the bending edge. The bending roller includes a sector-shaped notch formed along the rotation axis and formed, at least in part, by first and second bending shank edges. The bending roller includes a plurality of second bending segments positioned on the rotation axis to rotate about the rotation axis.

14 Claims, 11 Drawing Sheets

(51) Int. Cl.

| | |
|---|---|
| ***B21D 28/24*** | (2006.01) |
| ***B21D 5/02*** | (2006.01) |
| ***B21D 5/04*** | (2006.01) |
| ***B21D 11/20*** | (2006.01) |
| ***B21D 22/08*** | (2006.01) |
| ***B21D 22/26*** | (2006.01) |
| ***B21D 28/00*** | (2006.01) |

(52) U.S. Cl.
CPC ..... *B21D 5/08* (2013.01); *B21D 11/20* (2013.01); *B21D 22/08* (2013.01); *B21D 22/26* (2013.01); *B21D 28/00* (2013.01); *B21D 28/24* (2013.01)

(58) Field of Classification Search
CPC .... B21D 5/0254; B21D 5/0263; B21D 5/042; B21D 5/08; B21D 37/12; B21D 11/20
See application file for complete search history.

(56) References Cited

U.S. PATENT DOCUMENTS

2003/0064871 A1* 4/2003 Akami ..... B21D 5/02 483/1
2009/0071223 A1* 3/2009 Rogers ..... B21D 5/0209 72/481.1

FOREIGN PATENT DOCUMENTS

| | | | | |
|---|---|---|---|---|
| DE | 20018936 | U1 | | 3/2001 |
| DE | 10223637 | A1 | | 12/2003 |
| DE | 102015000958 | A1 | | 7/2015 |
| DE | 102015000959 | A1 | | 7/2015 |
| JP | 2000317529 | A | * | 11/2000 |

OTHER PUBLICATIONS

Machine Translation of JP 2000-317529, Translated Nov. 27, 2018, 6 Pages. (Year: 2000).*

* cited by examiner

TOOL FOR A PUNCHING MACHINE FOR RESHAPING PORTIONS OF A PLATE-SHAPED WORKPIECE AND METHOD THERETO

CROSS-REFERENCE TO RELATED APPLICATION

This application claims priority under 35 U.S.C. § 119(a) to German Application No. 10 2015 217 887.0, filed on Sep. 17, 2015, the entire contents of which are incorporated herein by reference.

TECHNICAL FIELD

The invention relates to a tool for reshaping portions of a plate-shaped workpiece, in particular, to a tool for a punching machine for reshaping portions of a workpiece.

BACKGROUND

German Patent Publication DE 200 18 936 U1 discloses a machine for sheet metal processing with a rotating bending tool. The rotating bending tool can be used to manufacture a single reshaped structure portion, such as a bracket, from a plate-shaped workpiece. The reshaped structure portion has a maximum width corresponding to the length of a bending stamp and a bending roller of the rotating bending tool. If narrower reshaped structure portions need to be manufactured, the plate-shaped workpiece has to be formed with reliefs that allow the entire length of the bending stamp and the bending roller to be located within the relief region. The rotating bending tool does not accommodate forming a plate-shaped worked piece into multiple reshaped structure portions, where the reshaped structure portions to be formed are narrowly separated from one another on a workpiece.

SUMMARY

Various embodiments disclosed herein provide reshaping tools for punching machines, where the reshaping tools are configured for manufacturing reshaped structure portions that have different widths and/or are closely spaced apart on a worksheet with minimal efforts.

Certain aspects of the invention help to reduce an effective length of a bending roller to prevent requiring large reliefs between portions of a sheet being formed into distinct bracket structures. Certain aspects provide segmented portions of the bending stamp and the bending roller to facilitate such configurations. Additionally, various embodiments are configured to individually realize multiple effective portions by which multiple adjacent reshapings, e.g. brackets, can be manufactured upon one stroke.

In certain embodiments, reshaping tools for a punching machine for reshaping at least one portion of a plate-shaped workpiece include a first tool portion having a first device configured to be held in a first tool holder of the punching machine and a bending stamp having a bending edge. The reshaping tools include a second tool portion having a second device configured to be held in a second tool holder of the punching machine and a bending roller configured to cooperate with the bending stamp to reshape the plate-shaped workpiece. The bending roller is rotatable around a rotation axis running in a direction parallel to the bending edge. The bending roller includes a sector-shaped notch formed along the rotation axis and formed, at least in part, by a first bending shank edge and a second bending shank edge. The bending roller includes a plurality of second bending segments positioned on the rotation axis and configured to rotate about the rotation axis.

In various implementations, the bending roller includes an actuation portion configured to be impinged in response to a relative motion of the bending stamp and the bending roller in a working stroke of the punching machine, so that the bending roller is rotatably deflectable out of a rest position during a reshaping process upon a bending deformation of the workpiece by the cooperation of the bending stamp and the bending roller.

In certain implementations, the sector-shaped notch of one bending roller in the plurality of bending rollers is formed at a different angle than the sector-shaped notch of another bending roller in the plurality of bending rollers.

In some implementations, the bending stamp includes a plurality of bending segments having substantially an entire face facing the workpiece of at least one of the first bending segments configured as a contact face on the workpiece during the reshaping process. In other implementations, the bending stamp includes at least one distance segment positioned on the axis between at least two bending segments of the plurality of bending segments.

In some implementations, substantially an entire face of at least one first distance segment facing the workpiece is a contact face configured to engage the work-piece during the reshaping process. In other implementations, a face portion of at least one first distance segment facing the workpiece is configured to remain spaced apart from the workpiece during the reshaping process.

In certain implementations, at least one first distance segment includes a notch so that a portion of the face facing the workpiece of the at least one first distance segment is a contact face on the workpiece during the re-shaping process.

In various implementations, the reshaping tool includes at least one second distance segment provided between two second bending segments of the bending roller. The at least one second distance segment has a maximum outer dimension perpendicular to the rotation axis in an angle range of the sector-shaped notch so that the second distance segment does not intersect a plane parallel to the rotation axis and including the second bending shank edge. The bending roller comprises a shaft having a predetermined cross section. The two second bending segments and the second distance segments comprise an opening being complementary to the predetermined cross section of the shaft.

In certain implementations, at least one second distance segment is provided between two second bending segments of the bending roller. The at least one second distance segment has a maximum outer dimension perpendicular to the rotation axis in an angle range of the sector-shaped notch so that the at least one second distance segment does not intersect a plane being parallel to the rotation axis and including the second shank. The bending roller comprises a shaft having a predetermined cross section. At least one of the at least one second distance segments is annularly shaped having an inner diameter (di) being adapted to the diameter of the shaft.

In some implementations, the second tool portion includes a lateral guide respectively adjacent to the shaft on both sides. The lateral guide includes a circular segment-shaped groove in a surface facing the shaft in which groove a rolling movement of the shaft is guided.

In certain implementations, the second tool portion includes a first ejector supported in a spring-loaded manner in direction of the working stroke and an actuation portion of at least one of the second distance segments engages with the first ejector so that the bending roller is rotatably deflectable by an impingement of the first ejector by the working stroke of the punching machine.

In various implementations, the second tool portion includes a first ejector supported in a spring-loaded manner in a direction of the working stroke and the actuation portion of at least one of the second bending segments engages with the first ejector so that the bending roller is rotatably deflectable by an impingement of the first ejector by the working stroke of the punching machine.

In certain implementations, the second tool portion comprises a second ejector opposite the first ejector with respect to the bending roller. A coupling of the first ejector and the second ejector is provided so that the second ejector is movable simultaneously to the first ejector.

In another general aspect, the invention includes methods for manufacturing a reshaped structure portions of a plate-shaped workpiece with a reshaping tool. The methods include performing a working stroke by the punching machine. The methods include impinging the actuation portion of the second bending segments by the relative motion of the bending stamp to the bending roller so that the multiple second bending segments of the bending roller are deflected out of a rest position, such that the first bending shank edge of the respective second bending segment, in connection with the bending stamp, deforms the portion of the workpiece in a bending manner.

In certain implementations, the methods include impinging the actuation portion of the second bending segment or of the second distance segment by the relative motion of the bending stamp to the bending roller via the workpiece and a first ejector.

Embodiments of the invention are elucidated by reference to the attached drawings.

DETAILED DESCRIPTION

Figure 1:
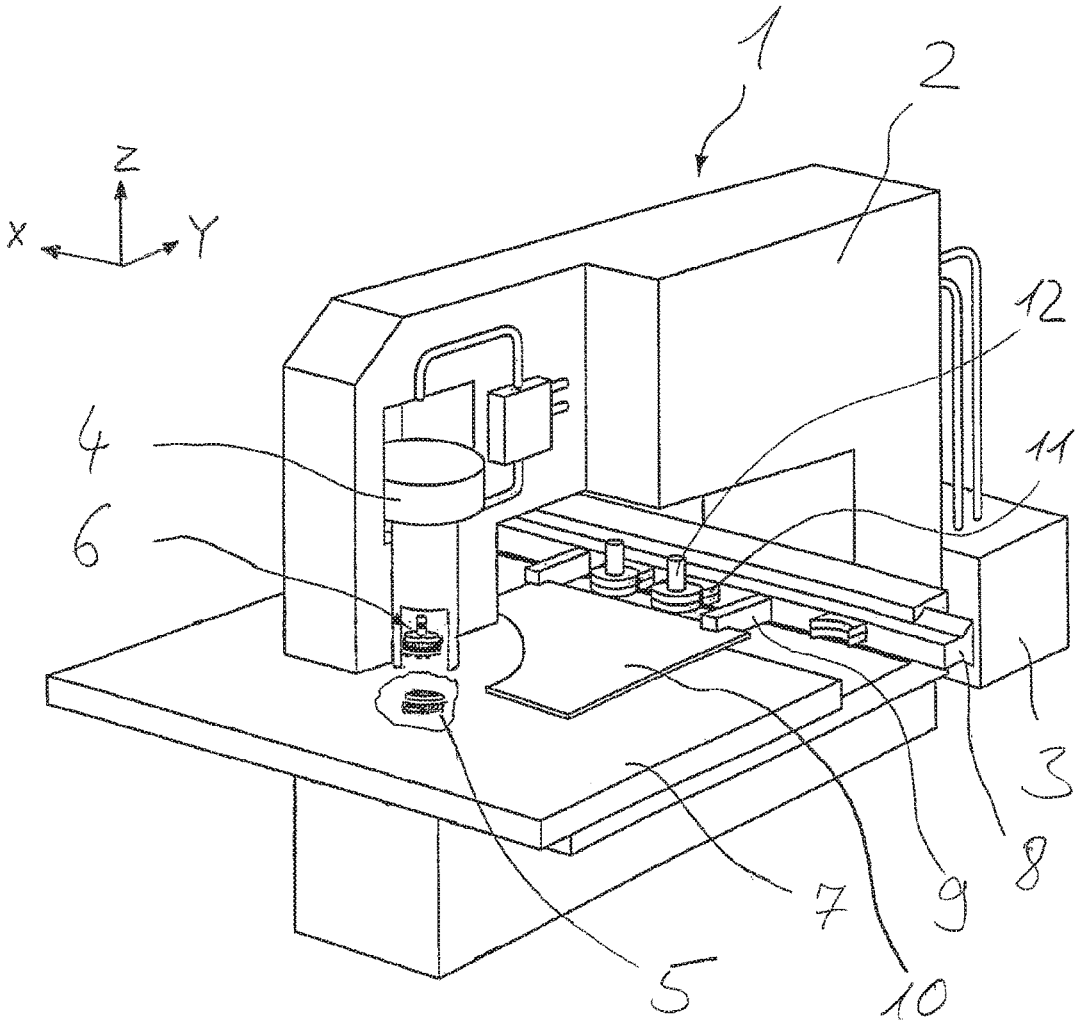
FIG. 1 shows a sheet metal processing machine in the form of a punching machine.

FIG. 1 illustrates an embodiment of a sheet metal processing machine, namely a punching machine 1. An essential component of the punching machine 1 is a C-frame 2. The C-frame 2 consists of a torsions-stiff welding construction made of steel. At the back end of the C-frame 2, a hydraulic power unit 3 by means of which a plunger 4 is hydraulically driven via a plunger drive (not shown) is provided. At the lower inside of the C-frame 2, a lower tool holder 5 for accommodating a tool lower portion of a punching or reshaping tool 12 is provided. The lower tool holder 5 is rotatable about 360 degrees by a rotary drive (not shown) and lockable in any arbitrary angular position. The plunger 4 is provided at the upper inside of the C-frame 2. The plunger 4 accommodates a tool upper portion of the punching or reshaping tool 12 with an upper tool holder in a backlash-free and a form-fit manner. The plunger 4 is also rotatable about 360 degrees and can be locked in any arbitrary angular position. Therefore, a second rotary drive (not shown) is provided.

At the lower inside of the C-frame 2, a machine table 7 is positioned and includes a cross rail 8 having a linear magazine for the punch or reshaping tools 12. Clamping claws 9 are arranged at the cross rail 8 for retaining a plate-shaped workpiece 10, here a sheet metal workpiece. In the linear magazine, a plurality, here three, tool holders 11 are provided for holding several, here two, tools 12.

In use, the machine table 7 travels in the Y-direction into a programmed position together with the cross rail 8, where the plate-shaped workpiece 10 is retained by the clamping claws 9. The cross rail 8 travels in the X-direction and into the programmed position, whereby the plate-shaped workpiece 10 slides over the machine table 7. Subsequently, a working stroke in which, according to the tool accommodated in the tool holders 5, 6, the plate-shaped workpiece 10 is punched or reshaped is performed by the plunger 4. The next punching position is approached according to the same principle following the punching or reshaping formed by the plunger 4.

Controlled by a machine controller (not shown), the punching or reshaping tools 12 are automatically exchanged. To exchange the tools 12 in the tool magazine, the cross rail 8 travels into a position in the X-direction driven by a linear drive (not shown) so that the X-position of the tool 12 to be exchanged corresponds to the X-position of the lower tool holder 5. Then, the cross rail 8, together with the machine table 7, driven by a further linear drive, travels into a position in the Y-direction where an axis of the tool 12 matches with a central axis of the lower tool holder 5 and of the plunger 4 so that the punching tool 12 can be accommodated in the lower tool holder 5 and into the upper tool holder 6.

Figure 2:
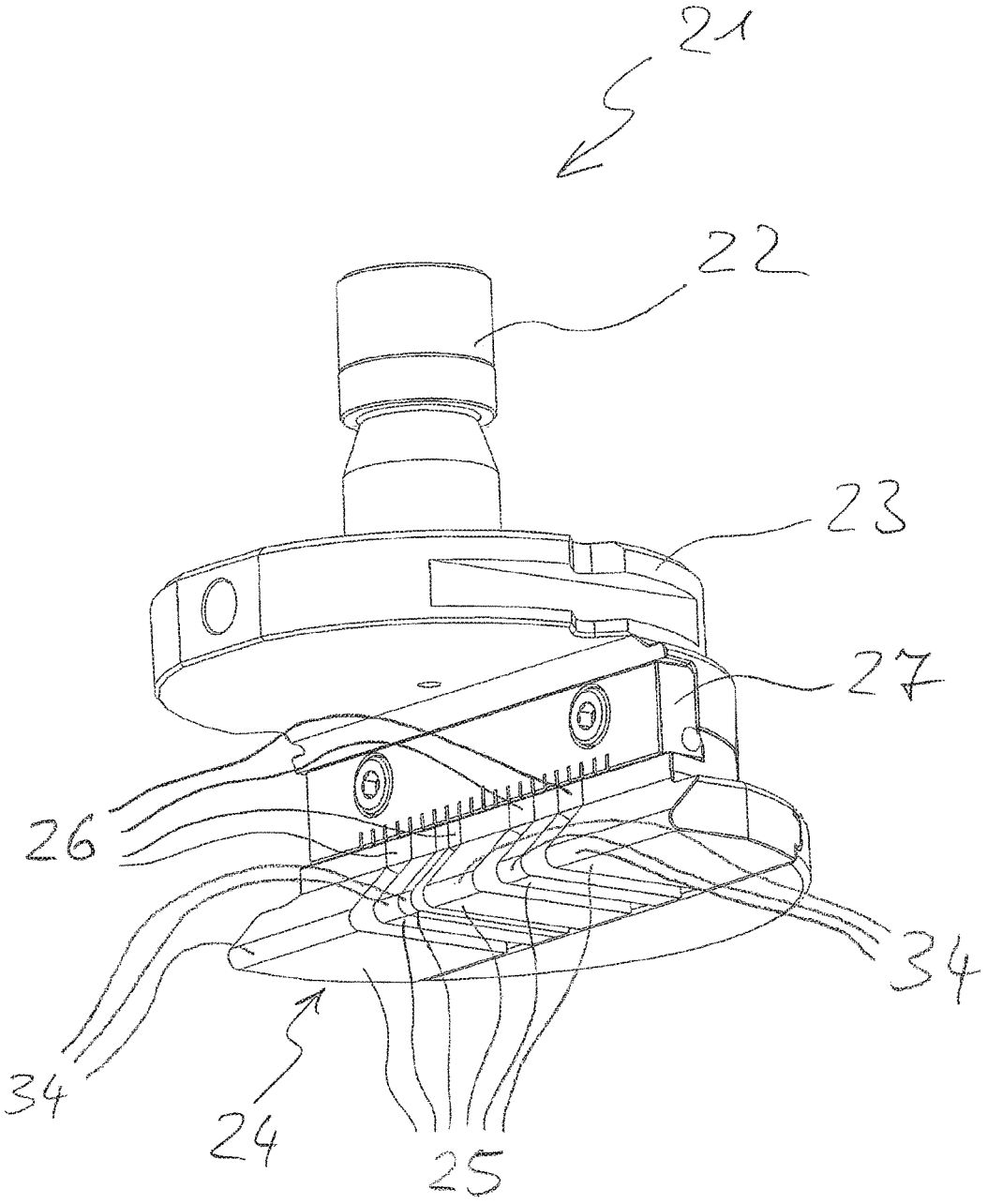
FIG. 2 shows an isometric view of a tool upper portion of the tool according to the invention.

FIG. 2 shows an isometric view of a tool upper portion 21 of a tool according to embodiments of the invention. The tool upper portion 21 comprises a stamp shaft 22 as a device for accommodation in the upper tool holder 6 of the punching machine 1. The tool upper portion 21 further comprises a first adapter flange 23, by means of which the tool upper portion can be accommodated in one of the tool holders 11 of the tool magazine. Opposite to the stamp shaft 22, the tool upper portion 21 comprises a bending stamp 24.

In this embodiment, the bending stamp 24 is segmented into multiple first bending segments 25. The bending stamp 24 further comprises a bending edge formed by aligned bending edges 34 at the bending segments 25. Between some of the first bending segments 25, first distance segments 26 are provided. One first distance segment 26 or multiple first distance segments 26 can respectively be provided. The first bending segments 25 and the distance segments 26 are fixed to the tool upper portion 21 via a clamping bar 27.

The first bending segments 25 and the first distance segments 26 can alternatively also be fixed to the tool upper portion 21 in another way, e.g., by screwing or by means of a dovetail connection.

In an alternative embodiment, a segmentation of the bending stamp 24 is not mandatorily necessary. Provided that no elevations are provided on the upper side of the plate-shaped workpiece 10 at locations where no portions to be reshaped are located, the bending stamp 24 can also be provided continuously with a bending edge 34.

Figure 3:
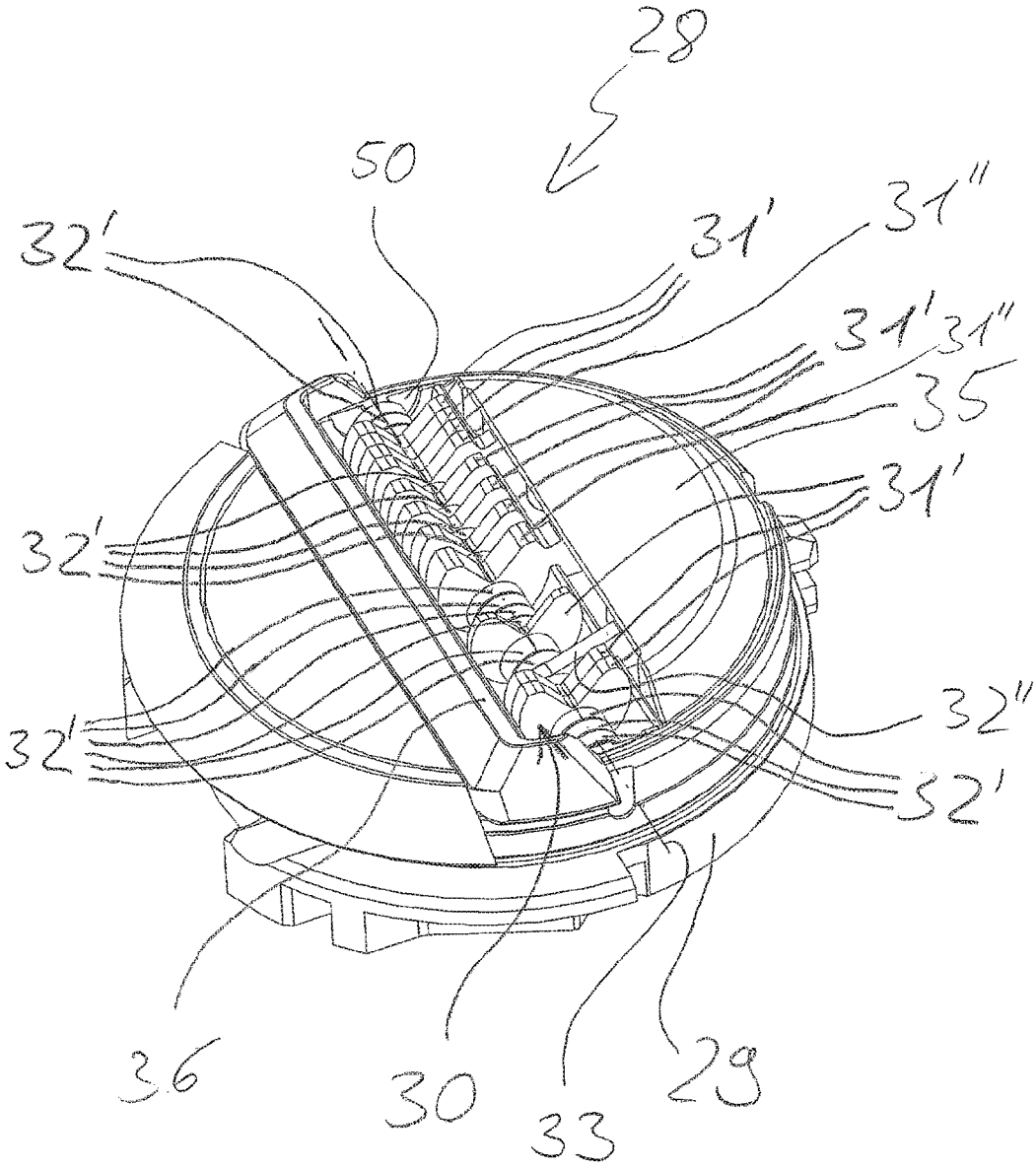
FIG. 3 shows an isometric view of an embodiment of a tool lower portion of the tool according to the invention.

FIG. 3 shows an isometric view of an embodiment of a tool lower portion 28 of the tool according to additional embodiments of the invention. The tool lower portion 28 includes a second adapter flange 29 by means of which the tool lower portion 28 can be held in the lower tool holder 5 and optionally, together with the tool upper portion 21, in one of the tool holders 11 of the tool magazine of the punching machine 1. The tool lower portion 28 further includes a bending roller 30. The bending roller 30 includes a shaft, on which second bending segments 31', 31", in particular bending segments of the bending roller 30, are arranged. Second distance segments 32', 32" are provided between some of the second bending segments 31', 31" to provide a desired spacing between the bending segments 31', 31". Multiple second distance segments 32', 32" can be provided between the second bending segments 31', 31". Later described lateral guides 50 are provided at both ends of the bending roller 30.

As described below, the first bending segments 25 of the tool upper portion 21 and the second bending segments 31', 31" of the tool lower portion 28 cooperate for reshaping portions of the plate-shaped workpiece 10, in this case as to be brackets. In certain embodiments, the cooperation can include ingress of a protruding portion, such as the bending edge 34 of the bending segment 25, into a recessed portion, such as a sector-shaped notch 38 of the bending segments 31 of the bending roller 30.

The first and second bending segments 25, 31', 31" are arranged at positions in the bending stamp 24 and in the bending roller 30 so that the brackets can be manufactured in the requested number, size and at the requested distances. The necessary position of the tool upper portion 21 and of the tool lower portion 28 for forming the reshapings in the requested positions of the plate-shaped workpiece 10 is determined by the programmed position of the plate-shaped work-piece 10. The second bending segments 31', 31" and the second distance segments 32', 32" in the tool lower portion 28 are rotatable about a rotation axis 33. The rotation axis 33 runs in a direction substantially parallel to the bending edge 34 of the bending stamp 24.

Optionally, the tool lower portion 28 is further provided with a first ejector 35 and a second ejector 36. The ejectors 35, 36 are supported in a spring-loaded manner in a direction of the working stroke of the plunger 4. With respect to the bending roller 30, the second ejector 36 is located opposite to the first ejector 35.

Here, the bending stamp 24 is included in the tool upper portion 21 and the bending roller 30 is included in the tool lower portion 28. In an alternative tool, the bending roller is provided in the tool upper portion and the bending stamp 24 is provided in the tool lower portion.

Figure 4A:
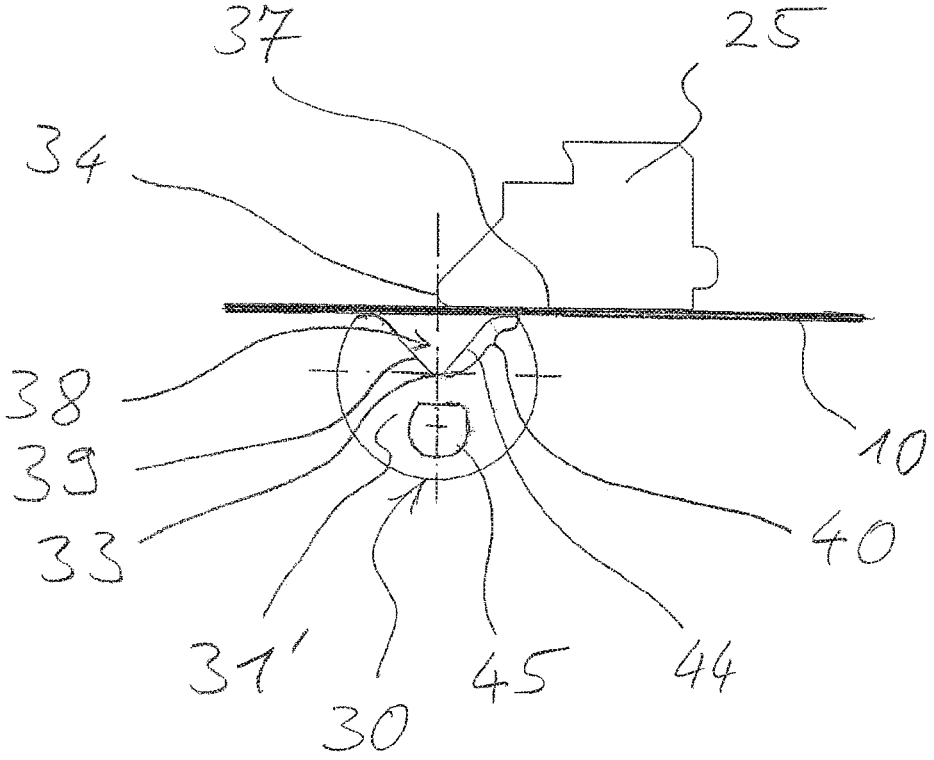
FIG. 4A shows a schematic side view of a segment of a bending stamp and of a bending segment before a reshaping process.
Figure 4B:
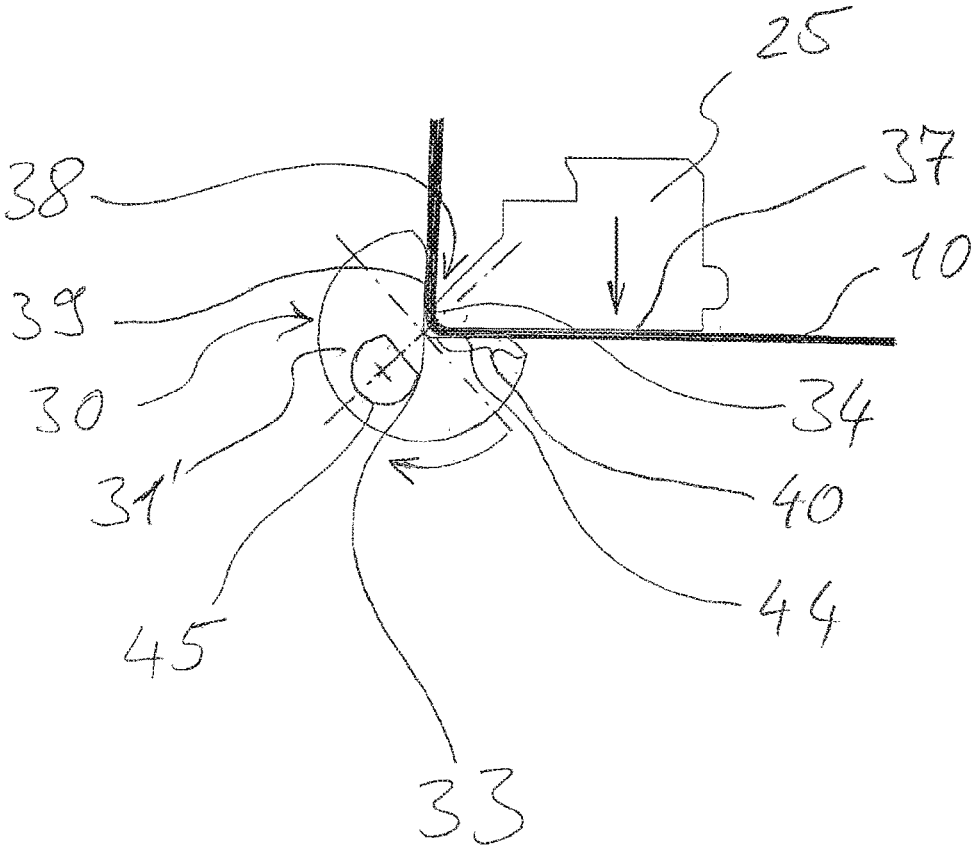
FIG. 4B shows a schematic side view of the segment of a bending stamp and of the bending segment during a reshaping process.

FIGS. 4A and 4B, respectively, show a schematic side view of a first bending segment 25 of the bending stamp 24 and of a first embodiment of the second bending segment 31' of the bending roller 30. In particular, FIG. 4A shows a situation before a reshaping process and FIG. 4B shows a situation during the reshaping process.

The first bending segment 25 comprises a face being almost entirely facing the plate-shaped workpiece 10 as a contact face 37. Excepted regions of the facing face are merely a radius of the bending edge 34 and possible radii or chamfers at the edges of the face. The second bending segment 31' has here a substantial circular cross section having a specific diameter around a central axis corresponding to the rotation axis 33. Along the rotation axis 33, the second bending segment 31' is provided with a notch 38 having a sector-shaped cross section, here a sector of 90 degrees. The second bending segment 31' is further provided with an opening 45 in which a later described shaft can be inserted.

One shank of the sector-shaped notch 38 is a bending shank edge 39 by means of which the portion of the plate-shaped workpiece is reshaped. A second shank edge 44 of the sector-shaped notch 38 here acts as an actuation shank which, together with a transition region toward the circular cross section, here being a radius, acts as an actuation portion 40.

In this embodiment, the sector-shaped notches 38 of the second bending segments 31', 31" have identical angles in order to respectively reshape the portions of the plate-shaped workpiece 10 into an identical shape. Alternatively, the sector-shaped notches 38 of the second bending segments 31', 31" can have different angles so that e.g. brackets having different angles with respect to the workpiece 10 can be bended out. The radius of the sector-shaped notch 38 close to the rotation axis 33 is chosen depending on the requested bending radius.

Figure 5A:
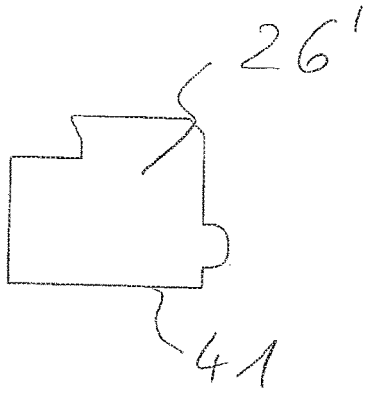
FIG. 5A, FIG. 5B and FIG. 5C show schematic side views of different embodiments of distance segments of the bending stamp.
Figure 5B:
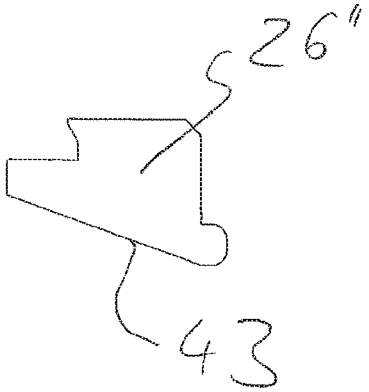
Figure 5C:
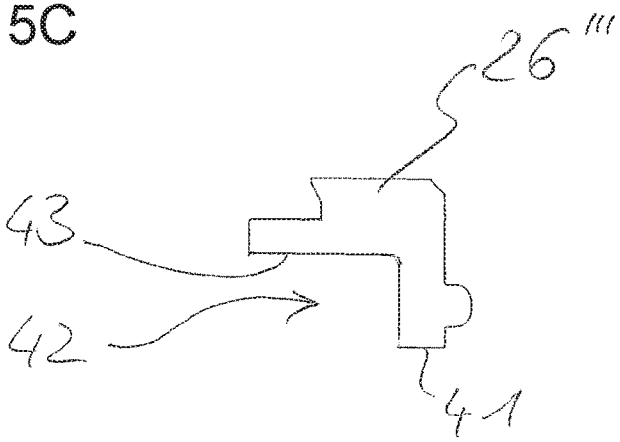

FIGS. 5A to 5C show schematic side views of different embodiments of the first distance segments 26 of the bending stamp 24. Analogous to the first bending segment 25, in FIG. 5A, the first distance segment 26' comprises a face that faces the workpiece 10 almost entirely, as a contact face 41 during the reshaping process. The first distance segment 26' is distinguished from the first bending segment such that the first distance segment 26' has a shape without bending edge 34.

FIG. 5B shows the first distance segment 26" that, contrary to the first distance segment 26', does not comprise any contact face, but a chamfered lower face 43. Therefore, the face 43 of the first distance segment 26" that faces the plate-shaped workpiece 10 is spaced apart from the workpiece 10 during the reshaping process.

FIG. 5C illustrates the distance segment 26''' comprising a relief 42 at the face that faces the workpiece 10. By the relief 42, the distance segment 26''' comprises a contact face 41 in a portion of the face 43 that faces the workpiece 10, whereas, a further portion of the face that faces the workpiece 10 is spaced apart from the plate-shaped workpiece 10 during the reshaping process. The distance segment 26''' is deployed directly beside the first bending segments 25 when upwardly directed reshapings are provided in non-reshaped regions close to the reshaped portions.

Figure 6:
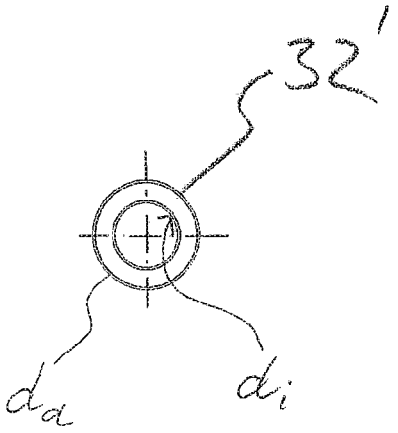
FIG. 6 shows a side view of an embodiment of a distance segment of the bending roller.

FIG. 6 shows a side view of an embodiment of a second distance segment 32', namely of a distance segment of the bending roller 30. The second distance segment 32' is annularly shaped and has an outer diameter da having a maximum dimension such that a plane including the second shank 44 and being parallel to the rotation axis 33 is not intersected by the second distance segment 32'. Thereby, in the position of the second bending segment 31' shown in FIG. 4B, in which the second shank 44 abuts on a lower side of the workpiece 10, the second distance segment 32' does not penetrate into the plate-shaped workpiece 10 and does not deform it. An inner diameter "di" of the second distance segment 32 is adapted to the diameter of the later described shaft of the bending roller 30.

In use, a position of the plate-shaped workpiece 10 suitable for inserting the reshapings to be inserted at the requested positions is approached by the punching machine 1. When the workpiece 10 is located in the suitable position, the working stroke of the plunger 4 is performed by the punching machine 1 as shown in the FIGS. 4*a* and 4B.

During the travelling of the workpiece 10, the bending roller 30 is located in a rest position, i.e., in an orientation in which the sector-shaped notch 38 is directed in a direction towards the bending stamp 24. Advantageously, a bisectrix of the sector-shaped notch 38 is thereby perpendicular to the lower side of the plate-shaped workpiece 10.

Then, in the working stroke, as shown in FIGS. 4A and 4B, the first bending segment 25 of the bending stamp 24 is moved with respect to the second bending segment 31' of the bending roller 30. Thereby, the plate-shaped workpiece 10 is pressed by the contact face 37 and the bending edge 34 of the first bending segment 25 on the actuation portion 40 of the second bending segment 31' of the bending roller 30 so that the actuation portion 40 is impinged. Thereby, the second bending segment 31' and, thus, the bending roller 30 is rotatably deflected out of the rest position around the rotation axis 33. By the rotation of the second bending segment 31' and a further relative movement of the first bending segment 25 towards the second bending segment 31', the workpiece 10 is pressed into the notch 38 and, thereby, a portion corresponding to a width of the second bending segment 31' is deformed in a bending manner. To manufacture a square angle of the reshaped portion, as shown here, the portion is "over-bended," i.e., the first bending segment 25 is moved so far in the direction of the second bending segment 31' that the reshaped portion is slightly more deformed than a square angle, wherein, when separating the first bending segment 25 from the second bending segment 31', a square angle is manufactured by an elastic spring back of the material.

The number, the distance, and the dimensions of the reshaped portions depend on the number, the arrangement and the width of the second bending segments 31'.

Subsequent to this process, the next position of the plate-shaped workpiece 10 being suitable for inserting the next reshapings to be inserted at requested positions is approached.

Figure 7:
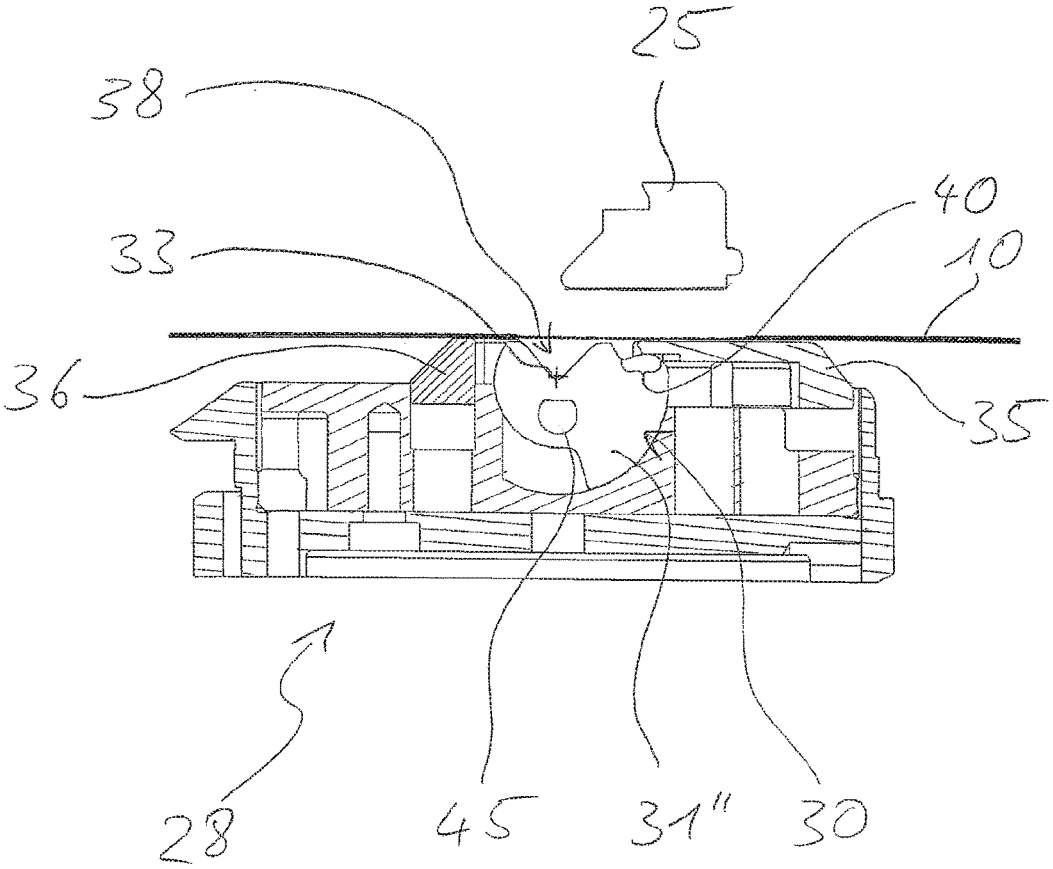
FIG. 7 shows a sectional side view of a segment of the bending stamp and of the tool lower portion of FIG. 3 with a bending segment of the bending roller before the reshaping process, wherein an actuation portion of the bending segment engages with an ejector.

FIG. 7 illustrates a sectional side view of the tool lower portion 28 of FIG. 3. In the tool lower portion 28, a second embodiment of the second bending segments 31" is provided. As in the second bending segment 31' shown in FIGS. 4A and 4B, the second bending segment 31" also comprises the sector-shaped notch 38 and the opening 45 for inserting the later described shaft. However, contrary to the second bending segment 31' shown in FIGS. 4A and 4B, here the actuation portion 40 does not consist of the second shank of the sector-shaped notch 38 and the transition portion toward the circular cross section of the bending segment 31'.

Like the second bending segment 31', the second bending segment 31" here includes a cross-section being circular with the determined diameter of the second bending segment 31' in a first sector around the rotation axis 33. However, a second sector also having an outer shape being circular segment-shaped radially around the rotation axis 33 is provided. The second sector comprises a second predetermined diameter being larger than the first predetermined diameter in the first sector. Due to the difference in the diameters, an actuation portion 40 located in a region outside the first predetermined diameter results. The tool lower portion 28 includes a notch that is complementary to the second sector in a range of movement of the second sector when rotating the second bending segment 31' and, therefore, the bending roller 30, so that the second sector can move in the notch and brace thereto so that also the shaft in the opening 45 is supported.

The first ejector 35 is arranged with respect to the second bending segment 31' such as the actuation portion 40 of the second bending segment 31" is located below a portion of the first ejector 35 so that the first ejector 35 engages with the actuation portion 40 of the second bending segment 31". The first ejector 35 further includes an overrun chamfer at its side averted from the bending roller 30 so that the workpiece 10 can easily overrun the tool lower portion 28.

In use, the actuating portion 40 of the second bending segment 31" of the bending roller 30 is not actuated directly via the workpiece 10 as in the case of the bending segment 31' of the first embodiment. Instead, the actuation portion 40 of the bending segment 31" is impinged by the relative movement of the bending stamp 24 towards the bending roller 30 via the workpiece 10 and the first ejector 35. Thereby, the bending roller 30 is moved out of its rest position already before the plate-shaped workpiece 10 impinges onto the second bending segments 31" so that a hit of the workpiece onto the resting bending roller 30 is prevented and damage of the sheet metal by the bending segments 31" is reduced or prevented.

Similarly to the first ejector 35, the second ejector 36 includes an overrun chamfer at the top edge at its side averted from the bending roller 30 so that the plate-shaped workpiece can easily overrun the tool lower portion 28 also from this side. The second ejector 36 is coupled to the first ejector 35 so that the second ejector 36 moves simultaneously with the first ejector 35. In a case in which the second ejector 36 would not be coupled to the first ejector 35, upon the working stroke of the punching machine 1, the second ejector 36 would be pressed downwardly merely by the plate-shaped work-piece 10. Thereby, there is the risk that the plate-shaped workpiece 10 in unintentionally deformed. By the coupling and the simultaneous motion, there is also the possibility to form smaller relieved regions around portions to be reshaped.

Figure 8:
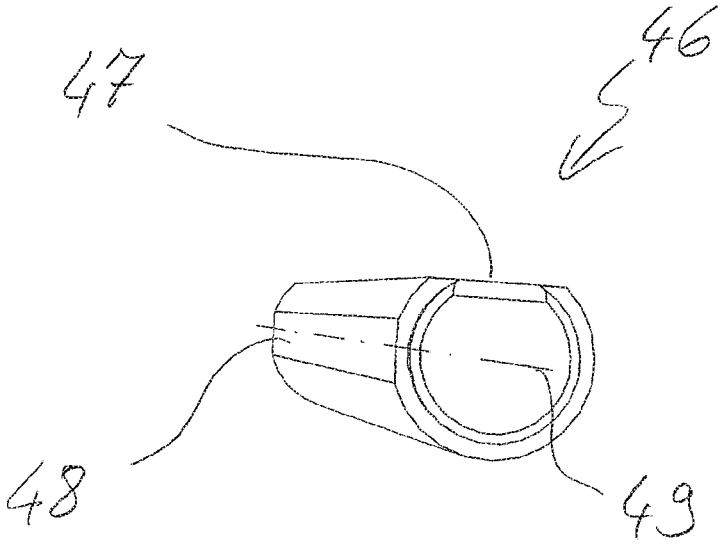
FIG. 8 shows a perspective illustration of a shaft of the bending roller.

FIG. 8 shows a perspective view of a shaft 45. The shaft 45 has a length that is slightly larger than the length of the bending roller 30. Furthermore, the shaft 46 has a circular cross section with a first flat section 47 and a second flat section 48. The size of the two flat sections is different. The shaft 46 fits into the opening 45 in the two bending segments 31' and 31" in a form-fit manner.

The first, larger flat section 47 is a tappet face. Thereby, mainly, a torque between the shaft 46 and the second bending segments 31', 31" is transmitted. By the impingement of the actuation portion 40 of the second bending segment 31" shown in FIG. 7, on the one hand, this second bending segment 31" is rotatably deflected via its actuation portion 40. Moreover, the torque for the rotatably deflection is transmitted to the second bending segment 31' which itself does not have an actuation portion engaging the first ejector 35 via the shaft 46 inserted in a form-fit manner into the openings 45 of the second bending segment 31" and the second bending segment 31'.

The second, smaller flat section 48 is an auxiliary face that serves as a coding so that the second bending segment 31', 31" cannot be mounted in a wrong orientation onto the shaft 46. The shaft 46 does not require a circular cross-section with flat sections, but can alternatively also have another cross-section as long as this is not symmetrical with respect to an axis that is perpendicular to an axis 49 of the shaft 46.

Figure 9:
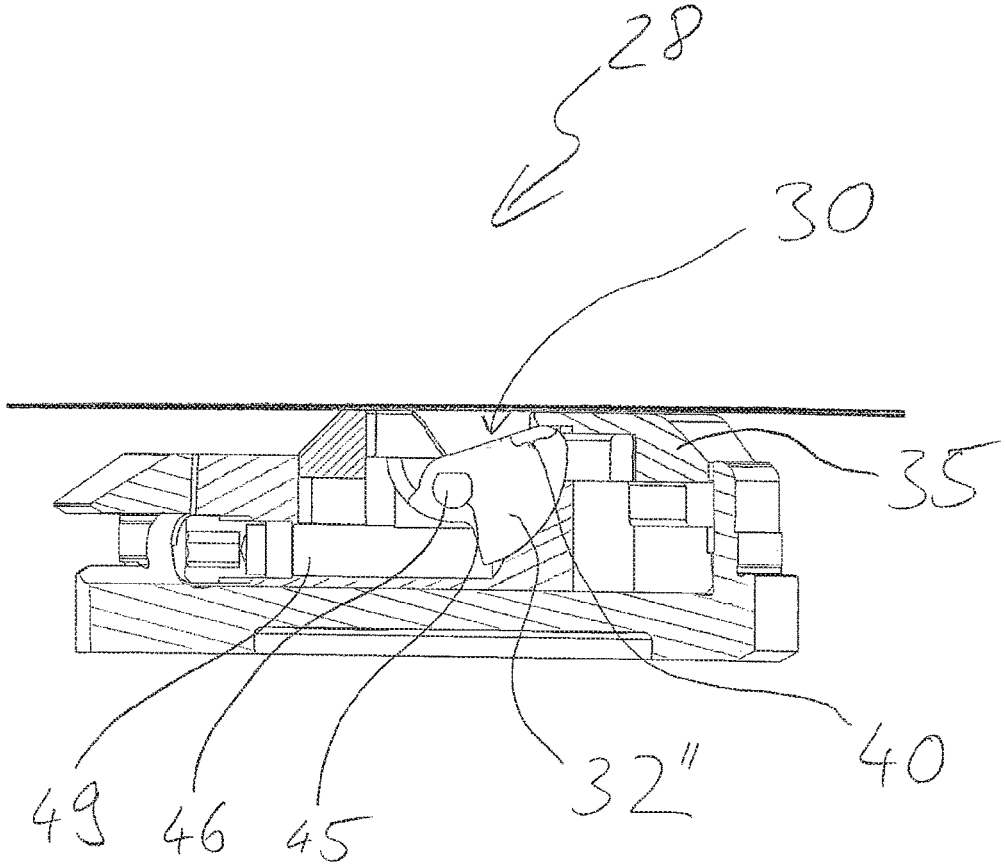
FIG. 9 shows a sectional side view of the tool lower portion of FIG. 3 with a distance segment of the bending roller before the reshaping process, wherein an actuation portion of the distance segment engages with the ejector.

FIG. 9, in turn, shows a sectional side view of the tool lower portion 28 of FIG. 3. Here, the cross-section is located such that a second embodiment of one of the distance segments 32" is shown. As, compared to the second bending segment 31', the second bending segment 31" comprises the second sector where the second predetermined diameter is larger than the first predetermined diameter of the first sector, the second distance segment 32" here also comprises a sector having a radius which is larger with respect to the radius of the second distance segment 32' shown in FIG. 6. Thereby, the actuation portion 40 engaging the first ejector 35 is formed also here. In a range of movement of the sector with the larger radius when rotating the second distance segment 32' and, thus, the bending roller 30, the tool lower portion 28 comprises a notch being complementary to this sector so that the sector can move in the notch and brace thereto. Thereby, the shaft 46 is supported via the second distance segment 32".

The second distance segment 32" comprises a maximum outer dimension in one angle range of the sector-shaped notch 38 of one of the adjacent second bending segments 31', 31" so that the plane which includes the second shank 44 of the sector-shaped notch 38 of the adjacent second bending segments 31', 31" and which is parallel to the rotation axis 33 is not intersected by the second distance segment 32". Thereby, in the position of the second bending segment 31' in which the second shank 44 abuts a lower side of the workpiece 10 shown in FIG. 4B, the second distance segment 32" does not penetrate into the plate-shaped workpiece 10 and does not deform it.

The second distance segment 32" also comprises the opening 45 in which the shaft 46 is accommodated in a form-fit manner. Thereby, a torque to the second bending segments 31', 31" can be transmitted via the shaft 46 by impinging the actuation portion 40 of the second distance segment 32" without the distance segment 32" itself performing a bending process.

FIG. 9 further shows a reset member 49 by which the bending roller 30 is urged into its rest position. The reset member 49 affect at a windage of the second distance segment 32" so that a defined orientation of the bending roller 30 is ensured in the rest position when the actuation portions 40 are not impinged. Thereby, collision of the bending roller 30 with the plate-shaped workpiece when overrunning the tool lower portion 28 is prevented.

Figure 10:
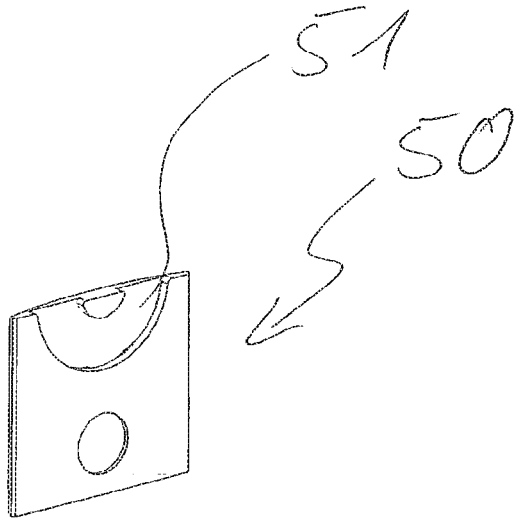
FIG. 10 shows an isometric illustration of a lateral guide of the shaft.

FIG. 10 shows an isometric illustration, already shown in FIG. 3, of the lateral guide 50 of the shaft 46. In a face being facing the shaft 46, the lateral guide 50 comprises a circular segment-shaped groove 51 respectively engaging with an end portion of the shaft 46. The lateral guide 50 is arranged on both sides adjacent to the shaft 46 arranged in the tool lower portion 28 such that the center of the circular segment-shaped groove 51 is located on the rotation axis 33. By the lateral guides 50, a rolling movement of the shaft 46 is guided and an unintended escape of the bending roller 30 out of the tool lower portion 28 is prevented.

The width of the first bending segments 25 can be different. The width of the second bending segments 31', 31" can also be different.

Other Embodiments

A number of embodiments of the invention have been described. Nevertheless, it will be understood that various modifications may be made without departing from the spirit and scope of the invention. Accordingly, other embodiments are within the scope of the following claims.

What is claimed is:

1. A reshaping tool for a punching machine for reshaping at least one portion of a plate-shaped workpiece, the reshaping tool comprising:
   - a first tool portion comprising a first device configured to be held in a first tool holder of the punching machine and a bending stamp having a bending edge; and
   - a second tool portion comprising a second device configured to be held in a second tool holder of the punching machine and a bending roller configured to cooperate with the bending stamp to reshape the plate-shaped workpiece,
   - wherein the bending roller is rotatable around a rotation axis running in a direction parallel to the bending edge,
   - wherein the bending roller comprises a sector-shaped notch formed along the rotation axis and formed, at least in part, by a first bending shank edge and a second bending shank edge, and
   - wherein the bending roller comprises a plurality of bending roller bending segments positioned on the rotation axis and configured to rotate about the rotation axis;
   - at least one bending roller distance segment provided between two bending segments of the bending roller,
   - wherein the at least one bending roller distance segment has a maximum outer dimension perpendicular to the rotation axis in an angle range of the sector-shaped notch so that the at least one bending roller distance segment does not intersect a plane being parallel to the rotation axis and including the second bending shank edge,
   - wherein the bending roller comprises a shaft having a predetermined cross section, and
   - wherein the two bending roller bending segments and the at least one bending roller segment comprise an opening that corresponds to the predetermined cross-section of the shaft.

2. The tool according to claim 1, wherein the bending roller comprises an actuation portion configured to be impinged in response to a relative motion of the bending stamp and the bending roller in a working stroke of the punching machine so that the bending roller is rotatably deflectable out of a rest position during a reshaping process upon a bending deformation of the workpiece by the cooperation of the bending stamp and the bending roller.

3. The tool according to claim 1, wherein the sector-shaped notch of one bending roller bending segment in the plurality of bending roller bending segments is formed at a different angle than the sector-shaped notch of another bending roller bending segment in the plurality of bending roller bending segments.

4. The tool according to claim 1, wherein the bending stamp comprises a plurality of bending stamp bending segments having substantially an entire face facing the workpiece and at least one of the plurality of the bending stamp bending segments is configured as a contact face on the workpiece during a reshaping process.

5. The tool according to claim 1, wherein the bending stamp comprises at least one bending stamp distance segment positioned on an axis between at least two bending stamp bending segments of the bending stamp.

6. The tool according to claim 5, wherein substantially an entire face of the at least one bending stamp distance segment facing the workpiece is a contact face configured to engage the work-piece during a reshaping process.

7. The tool according claim 5, wherein a face portion of the at least one bending stamp distance segment facing the workpiece is configured to remain spaced apart from the workpiece during a reshaping process.

8. The tool according claim 5, wherein the at least one bending stamp distance segment comprises a notch so that a portion of a face facing the workpiece of the at least one bending stamp distance segment is a contact face on the workpiece during a re-shaping process.

9. The tool according to claim 1, wherein the second tool portion comprises a lateral guide respectively adjacent to the shaft on both sides thereof, wherein the lateral guide comprises a circular groove in a surface facing the shaft in which groove a rolling movement of the shaft is guided.

10. The tool according to claim 1, wherein the second tool portion comprises a first ejector supported in a spring-loaded manner in a direction of a working stroke of the punching machine and an actuation portion of the at least one bending roller distance segment engages with the first ejector so that the bending roller is rotatably deflectable by an impingement of the first ejector by the working stroke of the punching machine.

11. A reshaping tool for a punching machine for reshaping at least one portion of a plate-shaped workpiece, the reshaping tool comprising:

a first tool portion comprising a first device configured to be held in a first tool holder of the punching machine and a bending stamp having a bending edge; and a second tool portion comprising a second device configured to be held in a second tool holder of the punching machine and a bending roller configured to cooperate with the bending stamp to reshape the plate-shaped workpiece, wherein the bending roller is rotatable around a rotation axis running in a direction parallel to the bending edge, wherein the bending roller comprises a sector-shaped notch formed along the rotation axis and formed, at least in part, by a first bending shank edge and a second bending shank edge, and wherein the bending roller comprises a plurality of bending roller bending segments positioned on the rotation axis and configured to rotate about the rotation axis, wherein at least one bending roller distance segment is provided between two bending roller bending segments of the bending roller, wherein the at least one bending roller distance segment has a maximum outer dimension perpendicular to the rotation axis in an angle range of the sector-shaped notch so that the at least one bending roller distance segment does not intersect a plane being parallel to the rotation axis and including the second bending shank edge, wherein the bending roller comprises a shaft having a predetermined cross section, and wherein the at least one bending roller distance segment is annularly shaped having an inner the predetermined cross section (di) corresponding to the diameter of the shaft.

12. A reshaping tool for a punching machine for reshaping at least one portion of a plate-shaped workpiece, the reshaping tool comprising:

a first tool portion comprising a first device configured to be held in a first tool holder of the punching machine and a bending stamp having a bending edge; and a second tool portion comprising a second device configured to be held in a second tool holder of the punching machine and a bending roller configured to cooperate with the bending stamp to reshape the plate-shaped workpiece, wherein the bending roller is rotatable around a rotation axis running in a direction parallel to the bending edge, wherein the bending roller comprises a sector-shaped notch formed along the rotation axis and formed, at least in part, by a first bending shank edge and a second bending shank edge, and wherein the bending roller comprises a plurality of bending roller bending segments positioned on the rotation axis and configured to rotate about the rotation axis, wherein the second tool portion comprises a first ejector supported in a spring-loaded manner in a direction of a working stroke of a punching machine and an actuation portion of at least one of the bending roller bending segments engages with the first ejector so that the bending roller is rotatably deflectable by an impingement of the first ejector by the working stroke of the punching machine.

13. The tool according to claim 12, wherein the second tool portion comprises a second ejector opposite the first ejector with respect to the bending roller, wherein a coupling of the first ejector and the second ejector is provided so that the second ejector is movable simultaneously with the first ejector.

14. A method for manufacturing a reshaped structure portion of a plate-shaped workpiece with a reshaping tool for a punching machine for reshaping at least one portion of the plate-shaped workpiece, the reshaping tool comprising:

a first tool portion comprising a first device configured to be held in a first tool holder of the punching machine and a bending stamp having a bending edge, and a second tool portion comprising a second device configured to be held in a second tool holder of the punching machine and a bending roller configured to cooperate with the bending stamp to reshape the plate-shaped workpiece, wherein the bending roller is rotatable around a rotation axis running in a direction parallel to the bending edge, wherein the bending roller comprises a sector-shaped notch formed along the rotation axis and formed, at least in part, by a first bending shank edge and a second bending shank edge, wherein the bending roller comprises a plurality of bending roller bending segments positioned on the rotation axis and configured to rotate about the rotation axis, and wherein the plurality of the bending roller bending segments respectively comprise an actuation portion configured to be impinged in response to a relative motion of the bending stamp and the bending roller in a working stroke of the punching machine so that the bending roller is rotatably deflectable out of a rest position during a reshaping process upon a bending deformation of the workpiece by the cooperation of the bending stamp and the bending roller, the method comprising:

performing a working stroke by the punching machine; and impinging the actuation portion of the bending roller bending segments by the relative motion of the bending stamp to the bending roller so that the plurality of bending roller bending segments of the bending roller are deflected out of the rest position of the bending roller, such that a first bending shank edge of a respective bending roller bending segment, in connection with the bending stamp, deforms the portion of the workpiece in a bending manner, further comprising impinging the actuation portion of one of the plurality of the bending roller bending segments or of a bending roller distance segment by the relative motion of the bending stamp to the bending roller via the workpiece and a first ejector.

* * * * *